US007407563B2

(12) United States Patent
Hietaniemi

(10) Patent No.: US 7,407,563 B2
(45) Date of Patent: Aug. 5, 2008

(54) APPARATUS AND METHOD IN THE TREATMENT OF THE STOCK PASSED TO A HEADBOX OF A PAPER MACHINE OR EQUIVALENT

(75) Inventor: Matti Hietaniemi, Tampere (FI)

(73) Assignee: Metso Paper, Inc., Helsinki (FI)

( * ) Notice: Subject to any disclaimer, the term of this patent is extended or adjusted under 35 U.S.C. 154(b) by 443 days.

(21) Appl. No.: 10/544,898

(22) PCT Filed: Feb. 5, 2004

(86) PCT No.: PCT/FI2004/000058

§ 371 (c)(1),
(2), (4) Date: Sep. 12, 2005

(87) PCT Pub. No.: WO2004/072365

PCT Pub. Date: Aug. 26, 2004

(65) Prior Publication Data

US 2006/0102308 A1 May 18, 2006

(30) Foreign Application Priority Data

Feb. 11, 2003 (FI) ..... 20030205

(51) Int. Cl.
*D21F 1/68* (2006.01)
*D21F 1/66* (2006.01)
*D21F 1/06* (2006.01)

(52) U.S. Cl. ..... 162/264; 162/189; 162/190; 162/191; 162/380

(58) Field of Classification Search ..... 162/189–191, 162/216, 258, 259, 262, 264, 336, 55, 380; 700/127–129; 209/728, 729; 96/207, 208, 96/215, 216
See application file for complete search history.

(56) References Cited

U.S. PATENT DOCUMENTS 5,916,417 A 6/1999 Cassidy et al.

(Continued)

FOREIGN PATENT DOCUMENTS

WO WO 01/21885 A1 3/2001

(Continued)

OTHER PUBLICATIONS

International Preliminary Examination Report issued in PCT/FI2004/000548.

(Continued)

*Primary Examiner*—Eric Hug
(74) *Attorney, Agent, or Firm*—Stiennon & Stiennon

(57) ABSTRACT

An apparatus in the treatment of stock passed to a headbox of a paper machine or equivalent includes at least two stock chests (10$a_1$, 10$a_2$). Stock ($M_1$) from a first stock chest (10$a_1$) is passed along a line ($a_1$, $a_2$) to a hydrocyclone plant (20) in the short circulation of the paper machine or equivalent. An accept line ($a_3$) of the hydrocyclone plant is connected with a stock line ($b_1$) of the stock ($M_2$) fed from a second stock chest (10$a_2$), and a combined stock flow is passed along a line ($b_2$) to the headbox (100) of the paper machine or equivalent. A method in the treatment of the stock passed to a headbox of a paper machine or equivalent is disclosed.

20 Claims, 4 Drawing Sheets

U.S. PATENT DOCUMENTS 6,267,845 B1 * 7/2001 Hautala et al. ..... 162/183

FOREIGN PATENT DOCUMENTS

WO WO 02/057542 A1 7/2002
WO WO 02/072948 A1 9/2002
WO WO 02/086233 A1 10/2002
WO WO2004/067838 * 8/2004
WO WO 2004/072365 A1 8/2004

OTHER PUBLICATIONS

Search Report issued in PCT/FI2004/000058.

* cited by examiner

APPARATUS AND METHOD IN THE TREATMENT OF THE STOCK PASSED TO A HEADBOX OF A PAPER MACHINE OR EQUIVALENT

CROSS REFERENCES TO RELATED APPLICATIONS

This application is a U.S. national stage application of international app. No. PCT/FI2004/000058, filed Feb. 5, 2004, the disclosure of which is incorporated by reference herein, and claims priority on Finnish App. No. 20030205, Filed Feb. 11, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an apparatus and a method in the treatment of the stock passed to a headbox of a paper machine or equivalent.

Centrifugal cleaning is needed in paper machines for separation of sand and contaminants. With today's technology, the cleaning efficiency of centrifugal cleaning deteriorates when the fiber consistency of the pulp suspension exceeds 1 percent. This limits the increasing of the feed consistency of the stock to be fed to the headbox. In practice, the slotted screen technique has made it unnecessary to use centrifugal cleaning for separating reject fibers, such as shives. A hydrocyclone plant is placed in the short circulation of the paper machine, where the flow rates are high, as high as 2000 l/s. To be operative, centrifugal cleaning requires a pressure difference of 120-150 kPa. In that connection, all (about 5) steps of the hydrocyclone plant require pumps, which represent as much as about 25 percent of the energy consumption of the short circulation. At a flow rate of 2000 l/s, the power consumption of centrifugal cleaning is about 1200 kW. A typical amount of fiber reject from centrifugal cleaning is about 0.1-0.2 percent of production. The loss of the filler pigments coming with coated broke is at its worst about 0.5 percent of machine production.

A filler recovery system is often incorporated in connection with the centrifugal cleaning of the short circulation. In addition to filler, the system must also process other rejects, such as fiber reject and sand, coming from the short circulation. In that case, the efficiency of the filler recovery system is not best possible.

Concepts are known in which the cleaning of the stock has been transferred from the short circulation to pulp lines. The consistency (about 3 percent) of the broke system is, however, not suitable for separation of sand with hydrocyclones.

When centrifugal cleaning is in the pulp line (e.g. chemical pulp, DIP or TMP), these pulps need not be cleaned again any more, but the debris, sand and non-disintegrating coating sheets of paper coming to the broke system via pulpers should be treated by means of hydrocyclones.

SUMMARY OF THE INVENTION

By placing a hydrocyclone plant in accordance with the invention in a broke system line in the short circulation, the problem is solved. The fiber consistency in the headbox can be increased, when needed, to a level of over 2 percent without the fiber consistency in the centrifugal cleaning exceeding the limit of 1 percent.

The size and the energy consumption of the hydrocyclone plant would be only about one third of the present size and energy consumption. The size is determined based on the maximal broke percentage.

At the same time, better selectivity is achieved in the filler recovery process.

In the invention, a hydrocyclone plant is placed in a stock line which is in the short circulation and uses broke, and it is connected with another stock line, so that the bulk of the stock flow (the purer stock) bypasses centrifugal cleaning.

The proposal reduces the energy consumption of centrifugal cleaning by about 65 percent, which means a saving of about 17 percent in the energy need of the short circulation. On a large machine the saved power is about 800 kW.

The amount of reject from centrifugal cleaning is reduced to a fraction, which means that the amount of reject from centrifugal cleaning would be in its entirety less than 0.05 percent of production. In practice, it could halve the amount of reject in the area of the paper mill, thus reducing the handling capacity associated with fiber recovery.

The investment in equipment is reduced by about 65 percent in centrifugal cleaning and by about 10 percent in respect of the short circulation. A hydrocyclone plant is a subprocess that takes up much space. By means of the arrangement in accordance with the invention, the paper machine hall is shortened by 3 m, with the result that the saving in building costs is considerable.

In accordance with the invention, a system is formed that includes at least two stock chests. The first stock chest comprises a stock composition $M_1$ containing pulp that requires centrifugal cleaning before it is passed to the headbox of the paper machine. The stock composition $M_1$ contains broke pulp passed from the paper machine and, in addition, it can contain pulp coming from fiber recovery and further mechanical pulp. The second stock chest comprises a stock composition $M_2$ containing pulp that has already undergone centrifugal cleaning, such as recycled fiber and/or chemical pulp and/or TMP. Thus, it does not contain any broke coming from the paper machine. In the arrangement in accordance with the invention, only the stock $M_1$ of the first stock chest is treated in the hydrocyclone plant and at least one accept is passed from it into connection with a second stock chest line and its stock $M_2$. There can be more stock chests than two.

The apparatus in accordance with the invention thus includes a hydrocyclone plant that is much cheaper in capital expenditure and takes up less space than that of the prior art because its capacity need not be as high as that of the prior art arrangements in which all stock is passed through a hydrocyclone plant. In the arrangement in accordance with the invention, it is only the stock $M_1$ which has come as broke that is passed through the hydrocyclone plant in the short circulation of the headbox.

In the following, the invention will be described with reference to some advantageous embodiments of the invention shown in the figures of the appended drawings, but the invention is not meant to be exclusively limited to them.

DESCRIPTION OF THE PREFERRED EMBODIMENTS

Figure 1A:
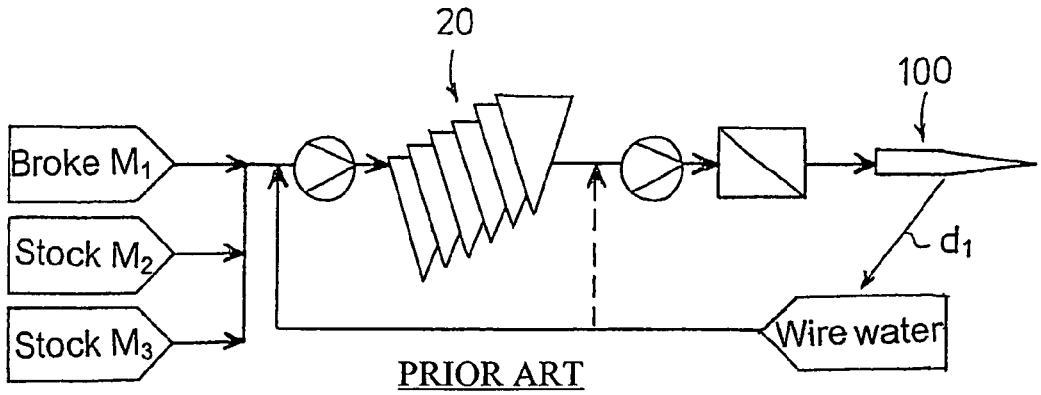
FIG. 1A shows a prior art apparatus for passing stock to a headbox of a paper machine.

FIG. 1A shows a prior art stock system in which all stock $M_1+M_2+M_3$ is passed to a hydrocyclone plant 20, which means that a high capacity is required from the hydrocyclone plant.

Figure 1B:
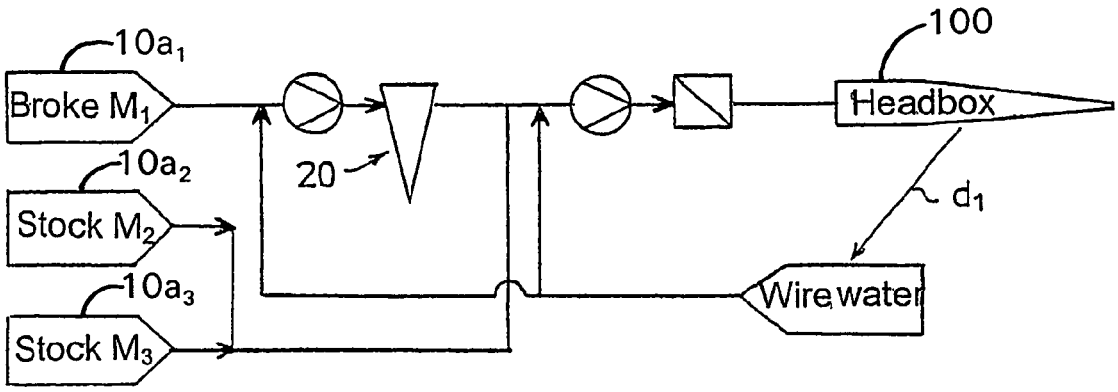
FIG. 1B shows an arrangement in accordance with the invention.

FIG. 1B shows an arrangement in accordance with the invention. A stock chest 10$a_1$ contains stock, i.e. a pulp fraction $M_1$, which contains broke passed from a paper machine and said pulp fraction $M_1$ is treated in a hydrocyclone plant 20. The cleaned stock, its accepts are passed further into connection with stocks $M_2$ and $M_3$ that do not contain broke and further to a headbox 100. The pulp fractions $M_2$ and $M_3$ that do not contain broke in stock chests 10$a_2$ and 10$a_3$ thus bypass the centrifugal cleaning 20, and the accept of the stock $M_1$ from the hydrocyclone plant 20 is passed into connection with said stocks $M_2$ and $M_3$. The hydrocyclone plant 20 is not required to have as high a capacity as that of the embodiment of FIG. 1A.

Figure 2A:
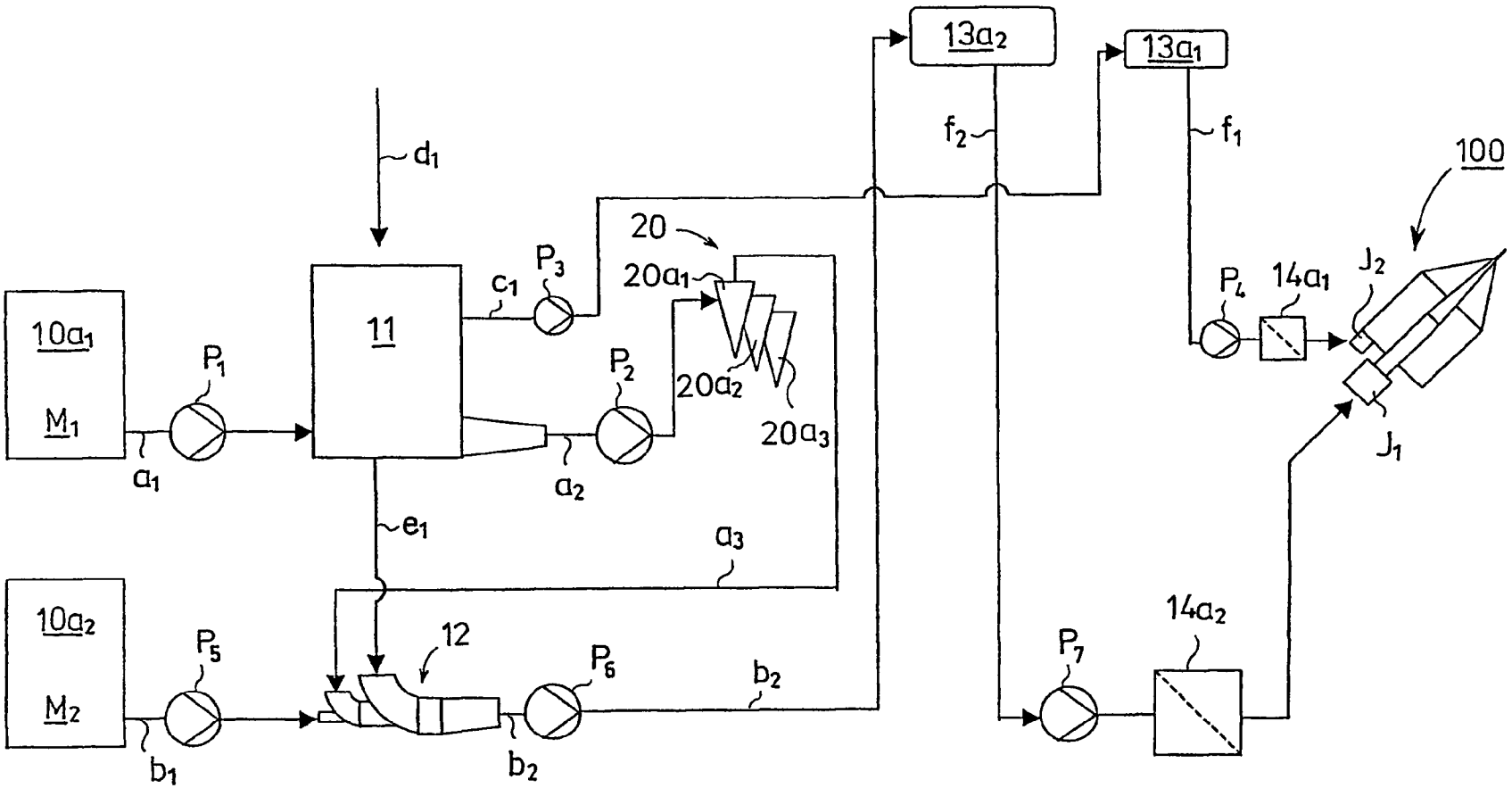
FIG. 2A shows a first embodiment of the invention in which broke-containing stock is passed from a first stock chest to a hydrocyclone plant, and in which embodiment the stock is passed through a wire pit.

In the embodiment of FIG. 2A, stock $M_1$, or a pulp fraction, of a first stock chest 10$a_1$ also comprises a stock composition that requires centrifugal cleaning before it is passed to a headbox of a paper machine. The stock $M_1$ contains broke coming from the paper machine and, in addition, it may contain pulp coming from fiber recovery, and further mechanical pulp.

Stock $M_2$ of a second stock chest 10$a_2$ comprises a stock composition that has already undergone centrifugal cleaning, such as recycled fiber and/or chemical pulp and/or TMP.

In the embodiment of FIG. 2A, the stock $M_1$ is passed from the stock chest 10$a_1$ through a stock line $a_1$ to a lower part of a wire pit 11. The line $a_1$ includes a pump $P_1$. In the lower part of the wire pit, the stock $M_1$ is diluted with wire water obtained from a wire section of a paper machine (not shown) along a line $d_1$ to a consistency required by a hydrocyclone plant 20. A line $a_2$ leads from the lower part of the wire pit 11 to the suction side of a pump $P_2$ and a line $a_2$ leads from the pressure side of the pump $P_2$ to a first centrifugal cleaning step 20$a_1$ of the hydrocyclone plant 20 situated in the short circulation of the paper machine. In the figure, the centrifugal cleaning steps are designated with 20$a_1$, 20$a_2$, 20$a_3$ . . . An accept line from the centrifugal cleaning step 20$a_1$ of the hydrocyclone plant 20; a line $a_3$ is passed further to join a line $b_1$ of the stock $M_2$ of the second stock chest 10$a_2$ via a mixing device 12. The mixing device 12 is also supplied with wire water from the wire pit 11 along a line $e_1$ for diluting the stock $M_2$ to be fed to the headbox 100 to a suitable consistency.

From the upper part of the wire pit 11 there is further a line $c_1$ for dilution water, said line $c_1$ including a pump $P_3$. The line $c_1$ leads further from the discharge side of the pump $P_3$ to a deaeration tank 13$a_1$. The dilution water passed through the deaeration tank 13$a_1$ is conducted further after the deaeration treatment to a discharge line $f_1$ and further while pumped by a pump $P_4$ to a machine screen 14$a_1$, whose accepted fraction, i.e. accept, is passed to a dilution inlet header $J_2$ in the headbox 100.

The stock chest 10$a_2$ is provided with the line $b_1$ for the stock and further to the suction side of a pump $P_5$. On the discharge side of the pump $P_5$, the line $b_1$ is connected to the mixing device 12, after which there is a pump $P_6$ in a line $b_2$ for pumping the combined stock further along the line $b_2$ to a deaeration tank 13$a_2$, from which a discharge line $f_2$ leads further to the suction side of a pump $P_7$. On the discharge side of the pump $P_7$, in the line $f_2$ there is a machine screen 14$a_2$, from which an accepted fraction, i.e. accept, is passed to a stock inlet header $J_1$ of the headbox 100.

In the device arrangement in accordance with the invention, only the broke-containing stock $M_1$ passed from the stock chest 10$a_1$ is treated in the hydrocyclone plant 20. An accept line $a_3$ leads from said hydrocyclone plant further into connection with the stock line $b_1$ of the stock $M_2$ of the second stock chest 10$a_2$. Since the stock $M_2$ of the second stock chest 110$a_2$ comprises stock that has already previously undergone centrifugal cleaning, said line can be connected directly to the headbox 100 of the paper machine, via its deaeration tank 13$a_2$ and machine screen 14$a_2$.

Figure 2B:
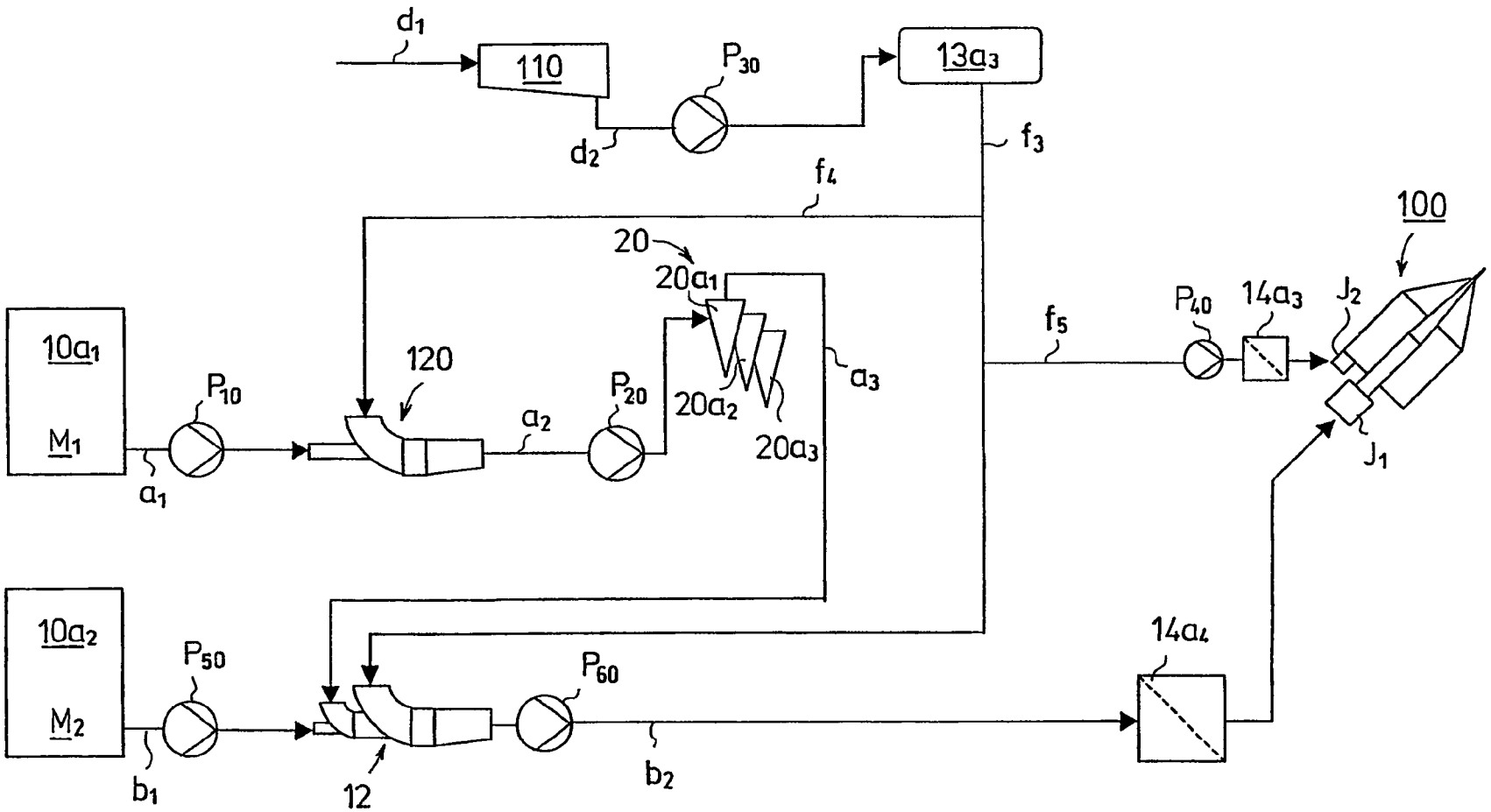
FIG. 2B shows a second embodiment of the invention.

In the embodiment of FIG. 2B, stock $M_1$, i.e. a pulp fraction, of a first stock chest 10$a_1$ also comprises a stock composition that requires centrifugal cleaning before it is passed to a headbox of a paper machine. The stock $M_1$ contains broke coming from the paper machine and it can additionally contain pulp coming from fiber recovery and further mechanical pulp.

Stock $M_2$ of a second stock chest 10$a_2$ comprises pulp that has already undergone centrifugal cleaning, such as recycled fiber and/or chemical pulp and/or TMP.

Also in this embodiment of the invention, only the stock $M_1$ passed from the stock chest 10$a_1$ is treated in a hydrocyclone plant 20. In the embodiment of the figure, the stock is passed from the stock chest 10$a_1$ through a line $a_1$ while pumped by a pump $P_{10}$ to a mixing device 120, in which the stock is diluted to a centrifugal cleaning consistency with wire water obtained from a line $f_4$, and the stock $M_1$ is passed further through a line $a_2$ to the suction side of a pump $P_{20}$. The line $a_2$ on the pressure side of the pump $P_{20}$ is connected to the hydrocyclone plant 20 to form the feed of its first centrifugal cleaning step 20$a_1$.

In the embodiment of FIG. 2B, the hydrocyclone plant 20 situated in the short circulation of the paper machine includes centrifugal cleaning steps 20$a_1$, 20$a_2$ and 20$a_3$. An accept line $a_3$ leads further from the first hydrocyclone, i.e. the centrifugal cleaning step 20$a_1$ of the hydrocyclone plant 20 into connection with a stock line $b_1$ of a second stock chest 10$a_2$.

In the embodiment, wire water from the paper machine is passed to a wire pit 110 through a line $d_1$, which wire pit 110 in this embodiment is formed by a planar wire pit structure, a so-called flume, which comprises a horizontal flow path for wire water. Said wire pit 110 removes effectively air in bubble form from the wire water, and pre-deaeration of the wire water is accomplished by means of said wire pit type. The wire water is passed from the wire pit 110 through a discharge line $d_2$ and a pump $P_{30}$ to a deaeration tank 13$a_3$, from which there is further a discharge line $f_3$ leading into connection with the line b, of the stock $M_2$ of the second stock chest 10$a_2$ via a mixing device 12. The line $f_4$ leads further from the discharge line $f_3$ of the deaeration tank 13$a_3$ into connection with the line $a_1$ of the stock $M_1$ of the first stock chest 10$a_1$ via the mixing device 120. A branch line $f_5$ leads further from the line $f_3$ to a pump $P_{40}$ and further from the pressure side of the pump $P_{40}$ to a machine screen 14$a_3$, which conducts the wire water further as accept from the machine screen 14$a_3$ to a dilution water inlet header $J_2$ of a headbox 100.

The stock $M_2$ is passed from the stock chest 10$a_2$ through a pump $P_{50}$ along the line $b_1$ to the mixing device 12 in order to be combined with the stock coming as accept along the line $a_3$ from the hydrocyclone plant 20 and with the dilution water coming along the line $f_3$. After that the diluted stock is pumped by means of a headbox feed pump $P_{60}$ through a machine screen 14$a_4$ to a stock inlet header $J_1$ of the headbox 100.

Figure 3:
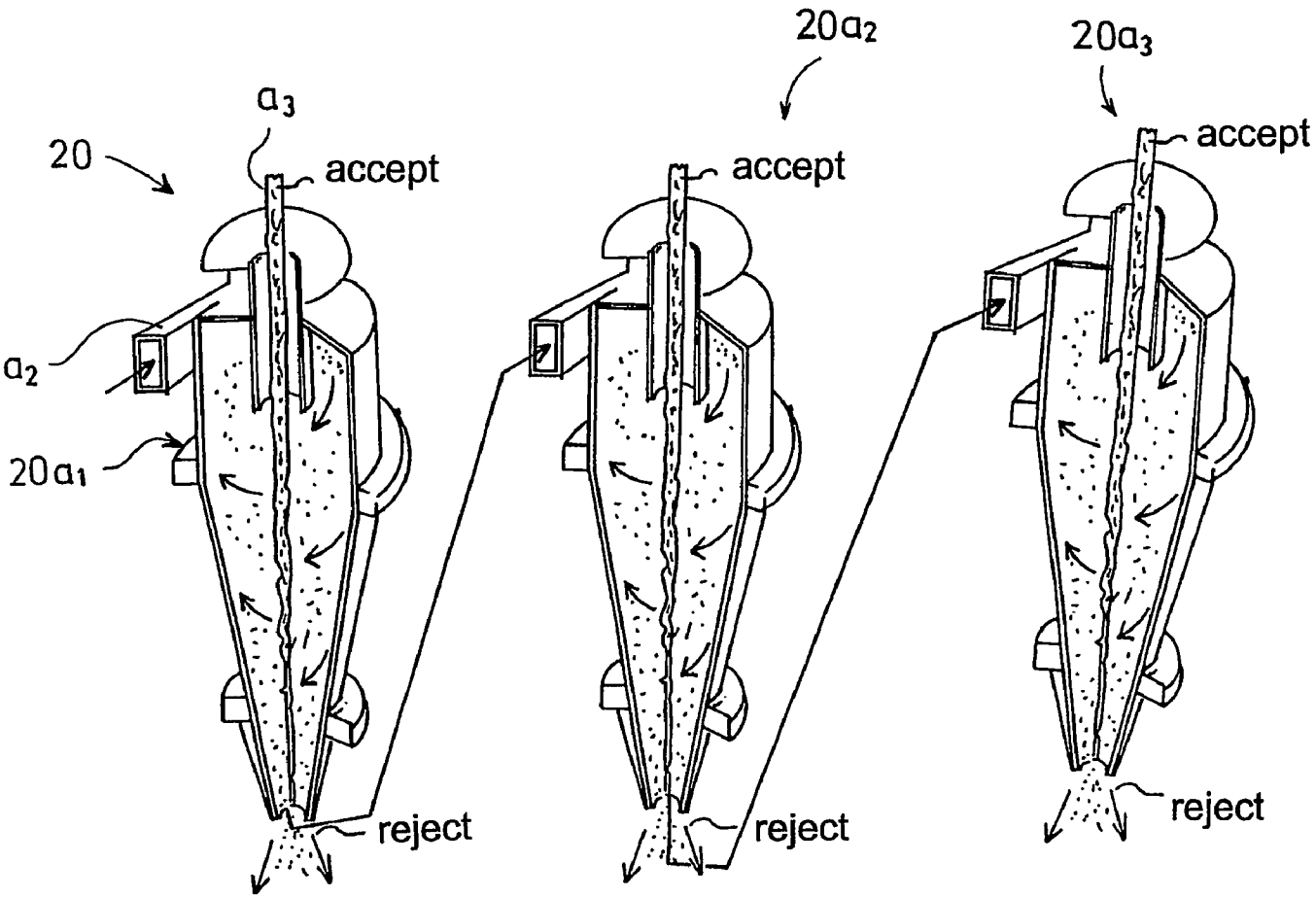
FIG. 3 is an illustration of principle of the operation of a hydrocyclone plant.

As shown in FIG. 3, the hydrocyclone plant 20 includes several centrifugal cleaning steps 20$a_1$, 20$a_2$, 20$a_3$, so that, as shown in the figure, accept from the first step 20$a_1$ is passed through the line $a_3$ further into connection with the line $b_1$ of the stock $M_2$ of the second chest 10$a_2$. As shown in FIG. 3, the stock is passed through the line a1 as a feed to the first centrifugal cleaning step of the hydrocyclone plant 20, i.e. to the hydrocyclone 20$a_1$. The stock flows along a spiral-shaped path inside the hydrocyclone 20$a_1$ and heavier particles separate as reject from the bottom of the hydrocyclone and lighter particles rise as accept further through the line $a_3$ into the line $b_1$ of the stock $M_2$ passed from the second stock chest 10$a_2$. There can be several hydrocyclones 20$a_1$, 20$a_2$, 20$a_3$ . . . and the reject from the first hydrocyclone 20$a_1$ can be passed further to the second hydrocyclone 20$a_2$ as its feed and the accept from it in one embodiment can be passed further to the line b, of the stock $M_2$ of the second stock chest 10$a_2$.

The figure shows a headbox 100. The headbox 100 in accordance with the invention is advantageously a so-called dilution headbox, which means that the dilution water passed to the dilution water inlet header $J_2$ is passed further across the width of the headbox to different points of the stock passed from the stock inlet header $J_1$ In this way, dilution makes it possible to regulate the basis weight of the web across the width of the web. The dilution water passed from the dilution water inlet header $J_2$ is passed to ducts which are provided with dilution water valves, by means of which the supply of dilution water can be regulated as desired across the width of the headbox, thus enabling the basis weight of the web to be regulated to be even across the entire width of the web.

As shown in the figure, the hydrocyclone plant can also include several accept lines, the stock passed through them being conducted into connection with another stock or with stocks passed from other chests. In accordance with the invention, it is also possible to use several stock chests, but in the invention only that stock, such as the broke-containing stock $M_1$, which shall be treated in the hydrocyclone plant is circulated through the hydrocyclone plant 20. The pulp fraction $M_2$ which need not be cleaned with hydrocyclones is passed directly to deaeration and, after a machine screen, to the stock inlet header $J_1$ of the headbox 100. The accept derived from the stock $M_1$ in the centrifugal cleaning 20 is conducted into connection with said stock.

When the stocks $M_1$ and $M_2$ of the chests 10$a_1$, 10$a_2$ are referred to in this application, it is also possible to call them a pulp fraction M, and a pulp fraction $M_2$. In this application, the paper machine is understood to mean paper, board and tissue machines.

The broke can be formed of paper broke, which can include trimmings or paper passed to a pulper in connection with web breaks.

The present application refers to lines by which are meant stock lines, pipes, ducts along which stock/wire water is passed.

The invention claimed is:

1. An apparatus for treatment of stock passing to a headbox of a paper machine, comprising:

a short circulation of the paper machine;

a first stock chest;

a hydrocyclone plant forming a part of the short circulation, the hydrocyclone plant connected to the first stock chest by a first stock transporting line, the hydrocyclone plant having an accept outlet line;

a second stock chest having a second stock transporting line;

a mixing device which is connected to receive stock from the second stock transporting line, the mixing device being connected in stock receiving relation to the accept outlet line so that stock flowing along the accept outlet line is mixed in the mixing device with stock flowing along the second stock transporting line; and wherein a third stock transporting line is connected in stock supplying relation to the headbox.

2. The apparatus of claim 1, wherein the first stock chest contains stock containing broke.

3. The apparatus of claim 2, wherein the stock in the first stock chest contains, in addition to broke pulp, recovered fiber pulp, and mechanical pulp.

4. The apparatus of claim 1, wherein the second stock chest contains stock which has been cleaned by hydrocyclones.

5. The apparatus of claim 4 wherein the second stock chest stock comprises recycled fiber or chemical pulp.

6. The apparatus of claim 1, further comprising;

a wire pit connected between the first stock chest and the hydrocyclone plant;

a deaeration tank having a discharge;

a wire water supply line connecting the wire pit to the deaeration tank;

a machine screen connected to receive wire water from the deaeration tank; and a dilution water inlet header, in wire water receiving relation to the deaeration tank and in dilution water supplying relation to the head box.

7. The apparatus of claim 6, further comprising;

a first pump connected between the first stock chest and the wire pit;

a second pump connected between the wire pit and the hydrocyclone plant;

a third pump connected between the wire pit and the deaeration tank; and a fourth pump connected between the deaeration tank discharge and the dilution inlet header.

8. The apparatus of claim 1, wherein the third stock transporting line is connected in stock supplying relation to the headbox through a stock inlet header of the headbox; and wherein the third stock transporting line includes:

a deaeration tank having a discharge line;

a pump connected to said deaeration tank discharge line and having a pressure side; and a machine screen which is connected to the pressure side of said pump and which is connected to the stock inlet header of the headbox.

9. The apparatus of claim 1, further comprising:

a wire pit connected between the first stock chest and the hydrocyclone plant; and a dilution water line from the wire pit which joins the accept outlet line and the second stock transporting line at the mixing device in supplying relation to the third stock transport line.

10. An apparatus for treatment of stock passing to a headbox of a paper machine, comprising:

a short circulation of the paper machine;

a first stock chest;

a hydrocyclone plant forming a part of the short circulation, the hydrocyclone plant connected to the first stock chest by a first stock transporting line, the hydrocyclone plant having an accept outlet line;

a second stock chest having a second stock transporting line, wherein the accept outlet line joins the second stock transporting line to form a third stock transporting line which is connected in stock supplying relation to the headbox, and wherein the accept outlet line joins the second stock transporting line so as to mix stock flowing along the accept outlet line with stock flowing along the second stock transporting line;

a mixing device between the first stock chest and the hydrocyclone, the mixing device forming part of the first stock line;

a second mixing device where the accept outlet line joins the second stock transporting line to form a third stock transport line which is connected in stock supplying relation to the headbox;

a first pump in the first stock line between the first stock chest and the first mixing device; and a second pump in the first stock line between the first mixing device and the hydrocyclone.

11. The apparatus of claim 10, further comprising a wire water line connected to a source of wire water in the paper machine, the wire water line including a wire pit followed by a deaeration tank, wherein after the deaeration tank the wire water line forms a first branch connected to the first mixing device, a second branch connected to the second mixing device, and a third branch connected to a pump and further to a machine screen and therefrom further to a dilution water inlet header in dilution water supplying relation to the head box.

12. A method for treating stock passed in a short circulation to a headbox of a paper machine comprising the steps of:

passing a first flow of stock to a hydrocyclone plant, and forming an accepts flow of stock;

combining the accepts flow with a second stock flow which has not passed through the hydrocyclone plant in a mixing device to form a combined stock flow; and passing the combined stock flow to the headbox of the paper machine.

13. The method of claim 12, wherein the first flow of stock is supplied from a first stock chest.

14. The method of claim 12, further comprising the step of forming the first flow of stock as a composition containing broke passed from the paper machine.

15. The method of claim 12, further comprising the step of forming the first flow of stock as a composition containing broke passed from the paper machine and pulp coming from fiber recovery or mechanical pulp.

16. The method of claim 13, wherein the second stock flow is taken from a second stock chest into which stock which has been cleaned by a hydrocyclone is passed.

17. The method of claim 12, wherein the second flow of stock contains recycled fiber or chemical pulp.

18. A method for reducing the energy used in a short circulation in a papermaking machine wherein a headbox is supplied stock from an inlet header and wherein the inlet header is supplied with stock from at least a first stock chest of stock which has not passed through a hydrocyclone and a second stock chest of stock which has passed through a hydrocyclone, the method comprising the steps of:

cleaning stock from the first stock chest with a hydrocyclone to form an accepts flow of stock;

mixing the accepts flow of stock with a flow of stock from the second stock chest in a mixing device to form a mixed stock; and supplying the mixed stock to the inlet header of the headbox.

19. The method of claim 18, further comprising the step of forming the stock in the first stock chest from broke passed from the paper machine.

20. The method of claim 18, further comprising the steps of:

recovering wire water from the papermaking machine; and diluting the stock from the first stock chest with said wire water to less than or equal to 1 percent consistency before cleaning the stock from the first stock chest with the hydrocyclone to form the accepts flow of stock.

* * * * *

UNITED STATES PATENT AND TRADEMARK OFFICE

CERTIFICATE OF CORRECTION

PATENT NO. : 7,407,563 B2
APPLICATION NO. : 10/544898
DATED : August 5, 2008
INVENTOR(S) : Matti Hietaniemi It is certified that error appears in the above-identified patent and that said Letters Patent is hereby corrected as shown below:

In column 4, line 15 of the issued patent, "$110a_2$" should be --$10a_2$--

In column 4, line 56 of the issued patent, "b," should be --$b_1$--

In column 5, line 22 of the issued patent, "b," should be --$b_1$--

In column 5, line 28 of the issued patent, "$J_1$" should be --$J_1$.--

In column 5, line 51 of the issued patent, "M," should be --$M_1$--

Signed and Sealed this

Thirtieth Day of September, 2008

JON W. DUDAS
*Director of the United States Patent and Trademark Office*